US005985424A

United States Patent [19]

DeMatte et al.

[11] Patent Number: 5,985,424

[45] Date of Patent: Nov. 16, 1999

[54] COATED PAPER FOR INKJET PRINTING

[75] Inventors: Michael L. DeMatte, Columbia; Sean T. Kelly, Olney, both of Md.

[73] Assignee: Westvaco Corporation, New York, N.Y.

[21] Appl. No.: 09/020,826

[22] Filed: Feb. 9, 1998

[51] Int. Cl.[6] ..... B41M 5/00

[52] U.S. Cl. ..... 428/212; 428/195; 428/211; 428/330; 428/331; 428/342; 428/478.2; 428/500; 428/522; 428/537.5

[58] Field of Search ..... 428/522, 478.2, 428/500, 195, 211, 537.5, 330, 331, 212, 342

[56] References Cited

U.S. PATENT DOCUMENTS

| | | | |
|---|---|---|---|
| 5,589,259 | 12/1996 | Hosoi et al. | 428/323 |
| 5,670,242 | 9/1997 | Asano et al. | 428/212 |

*Primary Examiner*—Pamela R. Schwartz

[57] ABSTRACT

The inkjet recording sheet of the present invention comprises a cellulosic sheet support, e.g., paper, having on at least one surface thereof an inkjet coating comprising, in combination, a porous base coat having a high absorption capacity for absorbing the vehicle of an inkjet ink, and an ink receiving coat having a superior capacity for keeping the dyes in the ink on the surface with minimal spreading, tailing or blurring, to provide a sharp image.

7 Claims, No Drawings

COATED PAPER FOR INKJET PRINTING

BACKGROUND OF INVENTION

The present invention relates generally to a recording sheet, and more particularly to an inkjet recording sheet, the ink receptive coating thereon and the paper substrate supporting the ink receptive coating.

Paper for recording sheets used in inkjet printing must rapidly absorb the ink to reduce drying time with little or no backside show-through. Further, diffusion of ink laterally on the surface of the recording sheet must be prevented in order to achieve high resolution without blurring. Thus, for obtaining color images having good color density and resolution, with good absorbtivity and water fastness as well as optical brightness, a coated paper for inkjet printing should be able to achieve these results without any substantial dimensional change. For this purpose, the base paper for ink receptive coatings is generally made from bleached chemical pulp to which fillers, dyes, and if required, sizing agents and strength enhancers are added. An example of a typical paper basestock for use in the manufacture of an inkjet recording sheet is disclosed in U.S. Pat. No. 5,589,259.

It is also known that paper substrates for inkjet recording can be improved by applying an under coat or base coat to the paper surface before applying the ink receptive coating. Such base coats generally comprise a pigment and binder where the coated surface has a porous structure resulting in a large amount of pores or voids in the base coat layer. An example of a base coat for an inkjet recording sheet that is subsequently provided with an ink receptive layer is disclosed in U.S. Pat. No. 5,670,242.

Finally, the ink receptive coatings for inkjet paper must provide a surface that is receptive to the inks used for printing. In the past, this result has been achieved through the use of high pigment-to-binder ratios, usually in combination with pigments or coating materials that provide a porus and permeable coating layer. Because of the highly specific requirements for inkjet printing, coating materials used in other printing processes generally are unsatisfactory for inkjet printing.

There are two primary requirements for inkjet printing. The first is that the ink receptive coating, the substrate, and any intermediate base coat must be absorbent enough to immobilize the vehicle of the inks away from the surface so that the inks will not smear. The second requirement is that the ink receptive coating must provide a means for keeping the dyes in the ink on the surface with no spreading, tailing or blurring of the ink drops.

These requirements are achieved in the present invention with a combination of base coat and top coat where the components are matched to achieve a cooperative relationship not found in the prior art.

In conventional inkjet recording sheets, a generally porous fine powder capable of absorbing an ink is coated on a paper surface with a binder. However, when ink is brought into contact with such a coating, the coating is unable to instantaneously absorb the entire amount, and thus it takes a finite time for the inks to be absorbed. This allows the ink drop to spread in a fairly wide range among the particles of the fine powder. The color density tends to be low towards the forward edge of the spread, and the ink tends to spread unnecessarily widely, whereby the entire color density tends to be correspondingly low. This tends to make the sharpness of the printed image low and color blending or blotting is likely to result. However it has now been found possible to overcome these drawbacks by suppressing the unnecessary spread of the ink drop, and to provide a means for the ink drop including its vehicle to be absorbed into the paper substrate as a whole.

For this purpose, according to the present invention, porous particles are provided in both the ink receptive layer and in the base coat layer in a manner such that they work in a cooperative fashion to provide a superior image with good drying capacity.

SUMMARY OF INVENTION

It is the general object of this invention to provide an inkjet recording paper that has superior performance during inkjet printing.

It is another object of the invention to provide a novel combination of basestock, base coat and ink receptive coat to achieve a glossy inkjet paper product having a TAPPI 75° gloss greater than 80%, and an ink drying time of under two minutes, with acceptable intercolor bleed and enhanced density of printed colors.

It is a further object of the present invention to provide a paper basestock for an inkjet recording sheet which has excellent dimensional stability when used with aqueous based inks.

Another object is to provide an improved base coat which has exceptional absorbtion capacity for absorbing the vehicle of inkjet inks.

A further object of the present invention is to provide an improved ink receptive coat which has superior performance for reproducing images.

A typical basestock for the inkjet recording paper of the present invention may have the following preferred characteristics:

| | |
|---|---|
| Basis weight | 106 g/m$^2$ |
| Caliper | 5.3 mil |
| TAPPI Brightness | 90% |
| TAPPI Opacity | 93% |
| Sheffield Smoothness | 150 seconds |
| Hercules Size | 400 seconds |

The base coat for the inkjet recording paper of the present invention consists essentially of pigment and binder, including, in a preferred embodiment, a mixture of precipitated calcium carbonate (PCC), calcined clay, and if desired, titanium dioxide, dispersed in a coating binder comprising, as an example, a mixture of polyvinyl acetate and soy protein.

The ink receptive coat for the inkjet recording paper also consists essentially of pigment and binder including, in a preferred embodiment, a pigment component, for example fumed or pyrogenic silica, dispersed in an emulsion prepared from styrene polymerized in the presence of polyvinylpyrrolidone. The use of this emulsion is believed to present a significant departure from the known prior art.

DETAILED DESCRIPTION

The inkjet recording paper of the present invention achieves enhanced properties as a result of a careful combination of basestock, base coat and in particular, the ink receptive coat. The basestock is preferably an alkaline paper having a basis weight in the range of 100–150 g/m$^2$ with a caliper of at least about 5.0 mil. The basestock is prepared from a bleached wood pulp furnish to which is added a sizing agent such as alkylketene dimer, and fillers such as precipitated calcium carbonate and kaolin clay. An example of a suitable precipitated calcium carbonate is ALBAGLOS supplied by Specialty Minerals. An example of a suitable kaolin clay is ANSILEX supplied by Englehard Chemical Company. The basestock thus formed is preferably size pressed with a mixture of starch and styrene maleic anhydride in a conventional manner. Finished basestock properties (typical values) are, caliper greater than 5.0 mils, and preferably about 5–7 mils; TAPPI opacity of about 90–95%; TAPPI brightness of about 80–95%; Sheffield smoothness of about 100–200 (units are approximately equivalent to cubic centimeters of air per minute times 10); and a Hercules size of about 300–900 seconds. This basestock is particularly advantageous for the novel inkjet sheet of the present invention because it provides exceptional dimensional stability during use.

The preferred base coat for the inkjet recording sheet of the present invention is prepared, in a preferred embodiment, from a formulation comprising a mixture of precipitated calcium carbonate (PCC) and calcined clay (which may also include titanium dioxide and ground calcium carbonate), dispersed in a binder comprising polyvinyl acetate and soy protein. The PCC pigment is incorporated into the coating formulation at a dry weight of from 70–80%. Calcined clay is incorporated into the coating formulation at a dry weight of from about 20–30%, and where desired, up to 10% titanium dioxide may be included to achieve enhanced opacity. Typical binders for the preferred embodiment include polyvinyl acetate (about 10–15%), an example of which is PVA 1103 supplied by National Starch Company, and protein (about 2–5%), an example of which is PROCOTE 200 supplied by Protein Technologies. In addition to these basic ingredients, there may be added sufficient ammonium hydroxide to dissolve the protein and a thickener such as ALCOGUM L28 (supplied by Alco Chemical Company) to reach the target viscosity. A viscosity in the range of from about 2000–3000 centipoise Brookfield (20 rpm, No. 4 spindle) is preferred at a solids content of about 60–65%. The base coat is applied to the basestock at a coat weight in the range 8–10 lbs/ream (ream size 3300 $ft^2$), each side with any suitable coating device known to those skilled in the art (blade coater preferred). The finished base coated sheet has typical properties of basis weight 120–140 $g/m^2$; caliper about 5–7 mils; TAPPI Brightness 80–95%; TAPPI Opacity 90–95%; and Sheffield smoothness of about 100–200 units. The base coated sheet prepared as described above is particularly advantageous for the novel inkjet recording paper of the present invention because of its enhanced absorbtivity.

The ink receptive coat for the inkjet recording paper of the present invention is applied directly over the base coat. It is designed to work synergistically with the base coat to provide superior printed images. The ink receptive coat is prepared from a formulation comprising fumed or pyrogenic silica having a surface area of about 140–200 $m^2/g$ as measured by the BET method, with an alumina content of from about 0.3–1.3%. A typical fumed silica useful for the present invention is sold under the tradename Degussa MOX 170 supplied by Degussa Company AG. It is desirable that the silica pigment component have a narrow particle size distribution range and large specific surface area to achieve maximum ink absorbtivity. The preferred binder component for the present invention is a mixture of polystyrene and polyvinylpyrrolidone. An example of such a product is POLECTRON 430 supplied by International Specialty Products. POLECTRON 430 is prepared by an emulsion polymerization process at a weight ratio of styrene to polyvinylpyrrolidone of about 70/30. Other suitable binders include polyvinylpyrrolidone, starch, copolymers of vinylpyrrolidone and vinyl acetate, and combinations of these materials. The pigment component of the coating formulation is preferably about 15% by weight, but may range from about 5 to 35%. The remainder comprises binder, on the order of about 85% by weight, but may range from about 65 to 95%. It is believed that the styrene component of the binder acts as a pigment in the coating to reduce bleed while improving the drying time of applied inks. For improved water and smear resistance of the ink jet recording sheet, the coating formulation may also include a cationic agent in the weight percent range of 0.5–10%. An example of such a material is a dispersable polydadmac sold under the tradename poly DADMAC 7544 by Nalco Chemical Company. In addition, where desireable, a fluorescent whitening agent may be added, for example FWA T110 sold by Clariant Company. The ink receptive coat is made up to a solids of about 35–43% and is applied over the base coat by any suitable coating apparatus known to those skilled in the art in an amount of about 3–6 lbs/ream (ream size 3300 $ft^2$) one or both sides.

The invention will be described in further detail with reference to the following Examples. It should be understood, however, that the invention is by no means restricted to these specific Examples.

EXAMPLE I an inkjet coating drawdown study, the effect of increasing the weight ratio of fumed silica to styrene-vinylpyrrolidone copolymer on image quality, ink drying time and gloss were determined. Previous inkjet prototypes, constructed of an absorbent base coat and a glossy, ink receptive top coat, featured good image quality and high gloss, but they exhibited lengthy ink drying times and persistent tackiness. The purpose of this study was to evaluate a pigment-binder combination of fumed silica and water insoluble styrene-vinylpyrrolidone emulsion copolymer as an ink-receptive top coat. Whereas vinylpyrrolidone homopolymer forms a tacky, water soluble film when applied as a coating, it was hoped that the styrene-vinylpyrrolidone copolymer would provide reasonable ink absorption with a reduced tackiness. The fumed silica, although not as porous as many precipitated synthetic silicas, features a very small agglomerate size (15 nm), and is therefore not as detrimental to gloss as the precipitated and gel silicas.

The experimental top coats were drawn down over a size pressed 80 pound rawstock that was previously base coated with a base coat formulation designed to have high absorbtivity and to be compatible in performance with the top coat formulations. The coating formulations are shown in Table I.

TABLE I

Base Coat
(60% Solids - 8 lb/side/ream)

| | | |
|---|---|---|
| Precipitated Calcium Carbonate (ALBAGLOS S) | (parts) | 65 |
| Calcined Clay (ANSILEX) | " | 25 |
| Titanium Dioxide | " | 10 |
| Polyvinyl Acetate (NS 1103) | " | 12 |
| Protein (PROCOTE 200) | " | 2 |
| $NH_4OH$ | (as required) | |
| Thickener (ALCOGUM L28) | (to 2000 cps) | |

Top Coat
(dry weight % 3–4 lb/ream)

| | 1 | 2 | 3 | 4 | 5 |
|---|---|---|---|---|---|
| Fumed Silica (MOX 170) | 15 | 20 | 25 | 30 | 35 |
| Styrene-Vinylpyrrolidone (POLECTRON 430) | 85 | 80 | 75 | 70 | 65 |
| Solids (%) | 32 | 32 | 30 | 29 | 29 |
| Viscosity (cps) | 700 | 850 | 750 | 630 | 950 |

After 24-hour storage, the coated samples were supercalendered (4 nips at 600 pli, 110 degrees F.). Test images were printed with an HP Deskjet 693 C inkjet printer. The results demonstrated that increasing the weight fraction of fumed silica in the coating caused both black and color ink density to decrease and both sheet and printed gloss to decrease. However, increasing the weight fraction of fumed silica from 15% to 35% reduced the drying time from 55 to 25 seconds. No effects on edge sharpness, intercolor bleed, or mottle were observed, and likewise, the weight fraction of fumed silica in the coating had no effect on sheet brightness.

EXAMPLE II

Another coating study was conducted to determine the influence of (1) base stock ash and sizing, (2) sizepress ingredients, (3) base coat application, and (4) coating formulation on inkjet print gloss, gamut, bleed and drying properties. It was found that the quality of the print was significantly affected by the base coat application and the top coat formulation. A coating formulation comprising fumed silica and styrene-vinylpyrrolidone (15/85) applied to a base coated sheet was far superior to the same coating applied to a sheet that was not base coated. This demonstrated the need for a double coated rather than a single coated product. Additionally, when a cationic quaternary amine (DADMAC), was added to the coating formulation, a 15–20% improvement was seen in color gamut and ink density along with an improvement in ink bleed. Meanwhile, the introduction of hydrophilic materials (silica/polyvinyl alcohol) to the sizepress to increase water absorbency, resulted in improved ink drying time, but produced a significant decrease in color gamut and optical density. Likewise small differences in internal size and ash levels did not affect inkjet print quality. Table II shows the sizepress, base coat and top coat formulations.

TABLE II

Size Press Formulation

| Component | SP-1 | SP-2 | SP-3 |
|---|---|---|---|
| Styrene Maleic Anhydride | 3 | — | — |
| Starch (PG 290) | 97 | — | — |
| Fumed Silica (Mox 170) | — | 80 | — |
| PVOH (Airvol 107) | — | 20 | — |
| Styrene Butadiene (Dow 620) | — | — | 100 |
| Ammonia | — | — | PH 8.5 |
| Solids (%) | 10 | 15 | 10 |

Base Coat

| Component | Parts |
|---|---|
| Precipitated Calcium Carbonate (ALBAGLOS S) | 75 |
| Calcined Clay (Ansilex) | 25 |
| Protein (PROCOTE 200) | 2 |
| PVAC (NS 1103) | 12 |
| ALCOGUM (L-28) | To 1485 cps |
| Solids (%) | 59.9 |

Top Coat

| Component | TC-1 | TC-2 |
|---|---|---|
| Fumed Silica (MOX 170) | 15 | 15 |
| Styrene-polyvinylpyrrolidone (POLECTRON 430) | 85 | 85 |
| Diallyldimethyl Ammonium Chloride DADMAC (Nalco 7544) | — | 5 |
| T-110 Optical Brightener | 1.3 | 1.3 |
| Solids (%) | 42.2 | 38.1 |
| Viscosity (cps) Brookfield | 5590 | 3600 |
| Hercules | 113/89 | 106/85 |

The coated sheets were supercalendered and printed on an HP Deskjet 890C printer. Of the conditions that were base coated, base coat weight was 8–9 lb/ream. From the print results, it was found that both paper and print gloss could only be achieved by double coating. When a base coat was not present, both paper and print gloss suffered. The addition of DADMAC increased color gamut and reduced the bleeding tendency of the inks although ink drying time was somewhat longer.

It will be appreciated by those skilled in the art that various changes and modifications can be made in the illustrated embodiments without departing from the spirit of the present invention. All such modifications and changes are intended to be covered by the appended claims.

What is claimed is:

1. An inkjet recording sheet having improved printing performance, said sheet comprising a paper substrate, a first base coat applied to at least one surface of said substrate, said base coat consisting essentially of a pigment and binder wherein the pigment comprises a mixture of calcined clay and precipitated calcium carbonate and the binder comprises a mixture of polyvinyl acetate and protein, a second ink receptive coat applied over said base coat, said ink receptive coat consisting essentially of a pigment and binder wherein the pigment comprises fumed silica and the binder comprises an emulsion of styrene polymerized in the presence of vinylpyrrolidone.

2. The inkjet recording sheet of claim 1 wherein the paper substrate has a basis weight of from about 100–150 g/m$^2$, a Sheffield smoothness within the range of 100–200, and a Hercules size of 300–900 seconds.

3. The inkjet recording sheet of claim 2 wherein the base coat comprises from about 35–75 parts precipitated calcium carbonate, 10–25 parts calcined clay, 0–25 parts titanium dioxide and 0–25 parts ground calcium carbonate.

4. The inkjet recording sheet of claim 3 wherein the base coat is applied to the paper substrate at a coat weight of about 8–10 lbs/ream.

5. The inkjet recording sheet of claim 4 wherein the ink receptive coat contains from about 5–35 parts fumed silica, 95–65 parts styrene vinylpyrrolidone, and a cationic agent in the weight percent range 0.5–10%.

6. The inkjet recording sheet of claim 5 wherein the ink receptive coat is applied over the base coat at a coat weight of about 3–6 lbs/ream.

7. The inkjet recording sheet of claim 6 wherein the base coat and ink receptive coatings are applied to each surface of the paper basestock.

* * * * *